US008851841B2

(12) United States Patent
Care

(10) Patent No.: US 8,851,841 B2
(45) Date of Patent: Oct. 7, 2014

(54) CEILING FAN

(75) Inventor: Cristian Victor Care, Connells Point (AU)

(73) Assignee: Martec Pty Ltd, Moorebank (AU)

( * ) Notice: Subject to any disclaimer, the term of this patent is extended or adjusted under 35 U.S.C. 154(b) by 558 days.

(21) Appl. No.: 13/168,253

(22) Filed: Jun. 24, 2011

(65) Prior Publication Data

US 2011/0318202 A1 Dec. 29, 2011

(30) Foreign Application Priority Data

Jun. 25, 2010 (AU) ..... 2010100672

(51) Int. Cl.
*F04D 29/36* (2006.01)
*F04D 25/08* (2006.01)

(52) U.S. Cl.
CPC ..... *F04D 25/088* (2013.01); *F04D 29/366* (2013.01)
USPC ..... 416/87; 416/5

(58) Field of Classification Search
CPC ..... F04D 25/088; F04D 29/36; F04D 29/364; F04D 29/366
USPC ..... 416/5, 131, 135, 140, 141, 142, 143, 416/144, 145, 219 R
See application file for complete search history.

(56) References Cited

U.S. PATENT DOCUMENTS

| | | | | |
|---|---|---|---|---|
| 1,445,402 | A * | 2/1923 | Le Velle | 416/87 |
| 2,079,942 | A | 5/1935 | Le Velle | 230/259 |
| 4,936,751 | A * | 6/1990 | Marshall | 416/246 |
| 7,153,100 | B2 | 12/2006 | Frampton et al. | 416/5 |
| 8,292,585 | B2 * | 10/2012 | Liu | 416/143 |
| 2002/0076329 | A1 * | 6/2002 | Chen | 416/236 R |
| 2008/0286103 | A1 * | 11/2008 | Gajewski et al. | 416/87 |

FOREIGN PATENT DOCUMENTS

| | | | |
|---|---|---|---|
| AU | 2009100833 A4 | 8/2009 | F04D 29/38 |
| AU | 2009100834 A4 | 8/2009 | F04D 29/34 |
| AU | 2010100481 A4 | 5/2010 | F04D 25/08 |

* cited by examiner

*Primary Examiner* — Ned Landrum
*Assistant Examiner* — Kayla McCaffrey
(74) *Attorney, Agent, or Firm* — Heslin Rothenberg Farley & Mesiti P.C.

(57) ABSTRACT

A ceiling fan comprising an electric motor that drives a circular plate, the circular plate has three or four equally spaced quadrants positioned adjacent its periphery each quadrant is secured to the plate to be pivotal thereto to provide limited acuate movement about the pivot axis, each quadrant having a fan blade secured thereto, the acuate movement of each quadrant being confined from a first position where the blades are within the periphery of the plate to a second position where the blades extend radially outwardly at the plate, each quadrant being attached to the plate by a coil spring which urges the quadrant into the first position, each quadrant being directly joined to the adjacent quadrant by a rigid tie bar so that any movement of one quadrant causes the same movement of all the other quadrants.

8 Claims, 9 Drawing Sheets

CEILING FAN

CROSS-REFERENCE TO RELATED APPLICATIONS

This application claims priority to Australia Patent Application No. 2010100672, filed Jun. 25, 2010, which is herein incorporated by reference in its entirety.

BACKGROUND OF THE INVENTION

This invention relates to a ceiling fan and more particularly a ceiling fan with retractable blades.

Ceiling fans with retractable blades are well known. One of the advantages of having retractable blades in a ceiling fan is that when the fan incorporates a light the fan in the refracted non use condition can constitute an attractive ceiling mounted centre light without unsightly blades. When the fan is operated the blades project radially outwardly to operate as a fan and then are retracted when the fan is not in use.

Ceiling fans with retractable blades are not new but they do suffer from inherent weaknesses often caused by out of balance forces generated as the blades swing outwardly. These forces can cause the blades to contact each other during the retraction process. These fans are also prone to clonking noises as the blades either expand outwardly or retract. All of these issues reduce the attractiveness of the proposition and it the consideration of these issues that have brought about the present invention.

SUMMARY OF THE INVENTION

According to the present invention there is provided a ceiling fan comprising an electric motor that drives a plate, the plate supporting three or four equally spaced members positioned adjacent its periphery, each member connecting a blade with the plate and being secured to the plate to be pivotal thereto to provide limited arcuate movement, each member having a fan blade secured thereto, the arcuate movement of each member being confined from a retracted position where the blades are substantially within the periphery of the plate to an open position where the blades extend radially outwardly at the plate, each member being urged by resilient means into the refracted position, each member being directly joined to the adjacent member by a rigid tie bar so that any movement of one member causes the same movement of all the other members, and wherein adjacent tie bars overlap one another without contact as the blades move from the retracted to the open positions.

The fan may incorporate a light and is understood that the fan could comprise three or four blades.

In use, as the plate spins the centrifugal forces cause the blades to move to the second position to extend radially outwardly of the plate. When the power is switched off and the plate slows down the coil springs draw the blades back to the first position substantially within the periphery of the plate.

BRIEF DESCRIPTION OF THE DRAWINGS

An embodiment of the present invention will now be described by way of example only with reference to the accompanying drawings in which.

DETAILED DESCRIPTION OF THE INVENTION

Figure 1:
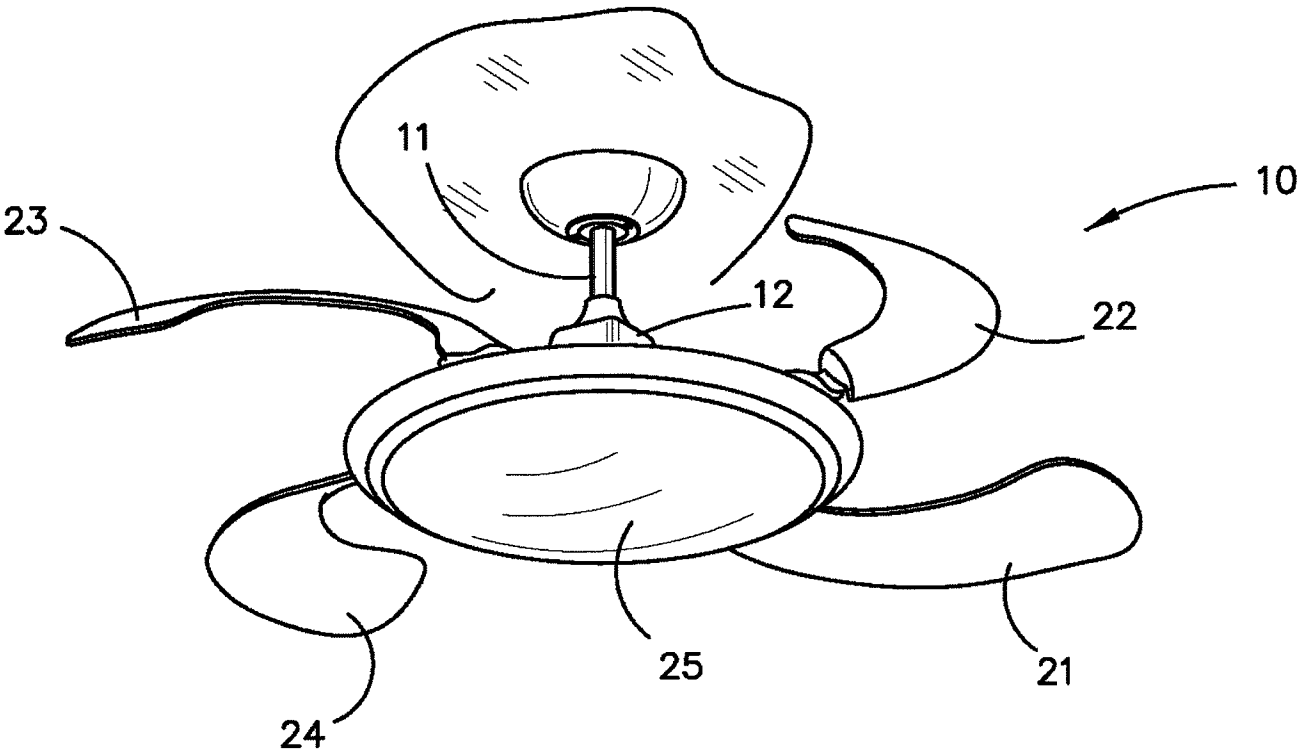
FIG. 1 is perspective view of a ceiling fan with blades in a radially expanded operative position.

The ceiling fan 10 shown in the accompanying drawings comprising a central ceiling mounted shaft 11 coupled to a housing 12 that houses an electric motor (not shown) that drives a rotor 15 that is mounted centrally of a circular plate 20. The periphery of the plate 20 supports four equally spaced fan blades 21, 22, 23, 24. The underside of the plate 20 supports a light (not shown) covered as shown in FIG. 1 by a curved cover 25. The four blades 21 to 24 are attached to the plate 20 to be retractable from an open position shown in FIG. 1 in which the blades extend radially outwardly to a closed position shown in FIG. 2 in which the blades are confined within or close to the periphery of the plate 20.

Figure 2:
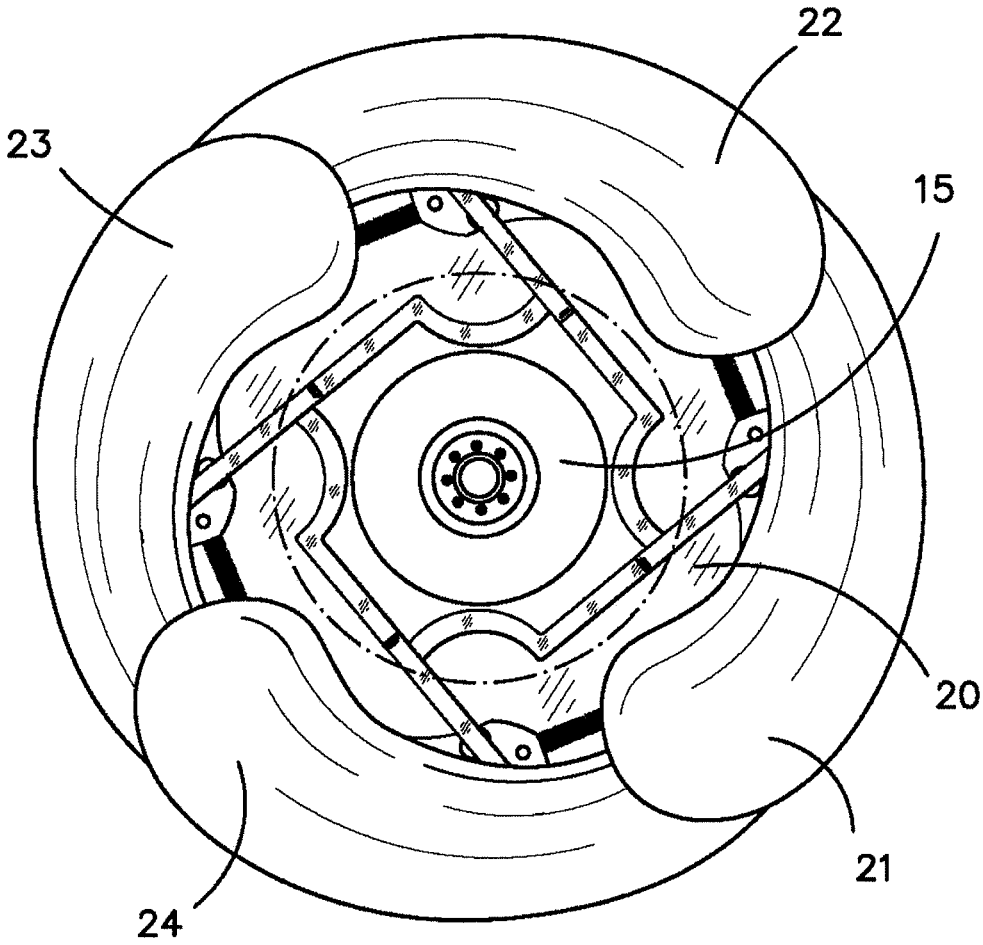
FIG. 2 is a plan view of part of the fan with the blades in a refracted position.
Figure 3:
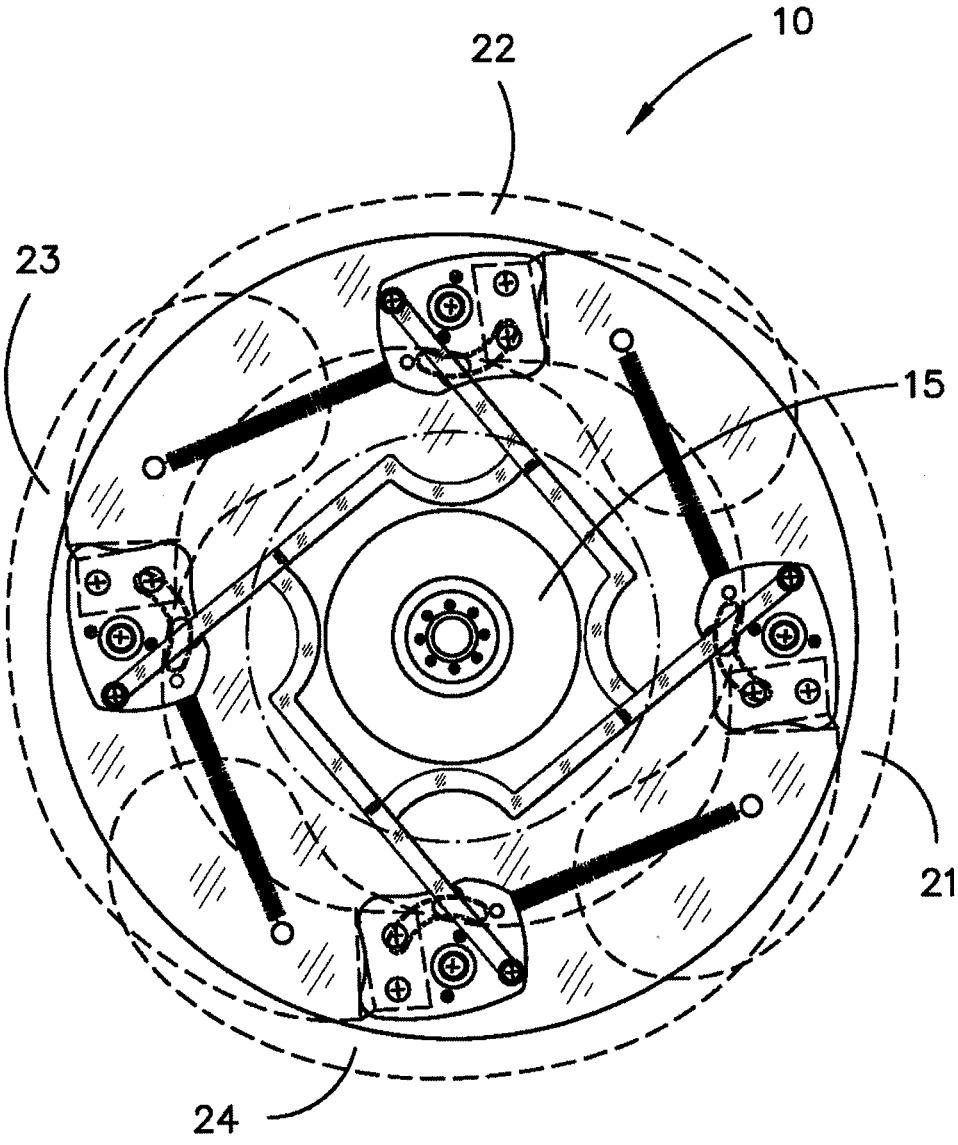
FIG. 3 is the same view with the blades shown in dotted profile.
Figure 4:
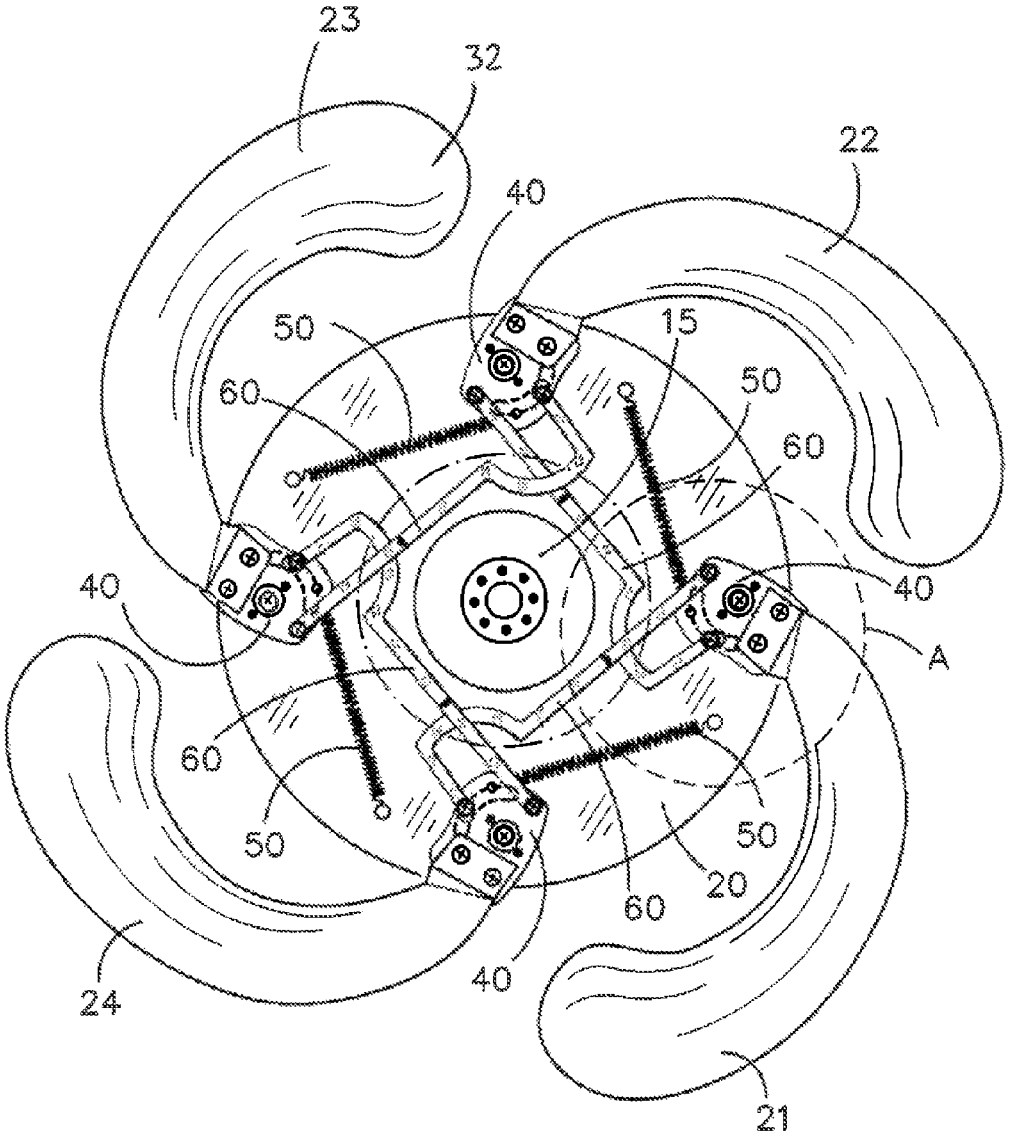
FIG. 4 is a plan view of part of the fan showing the blades in a partially expanded configuration.
Figure 5:
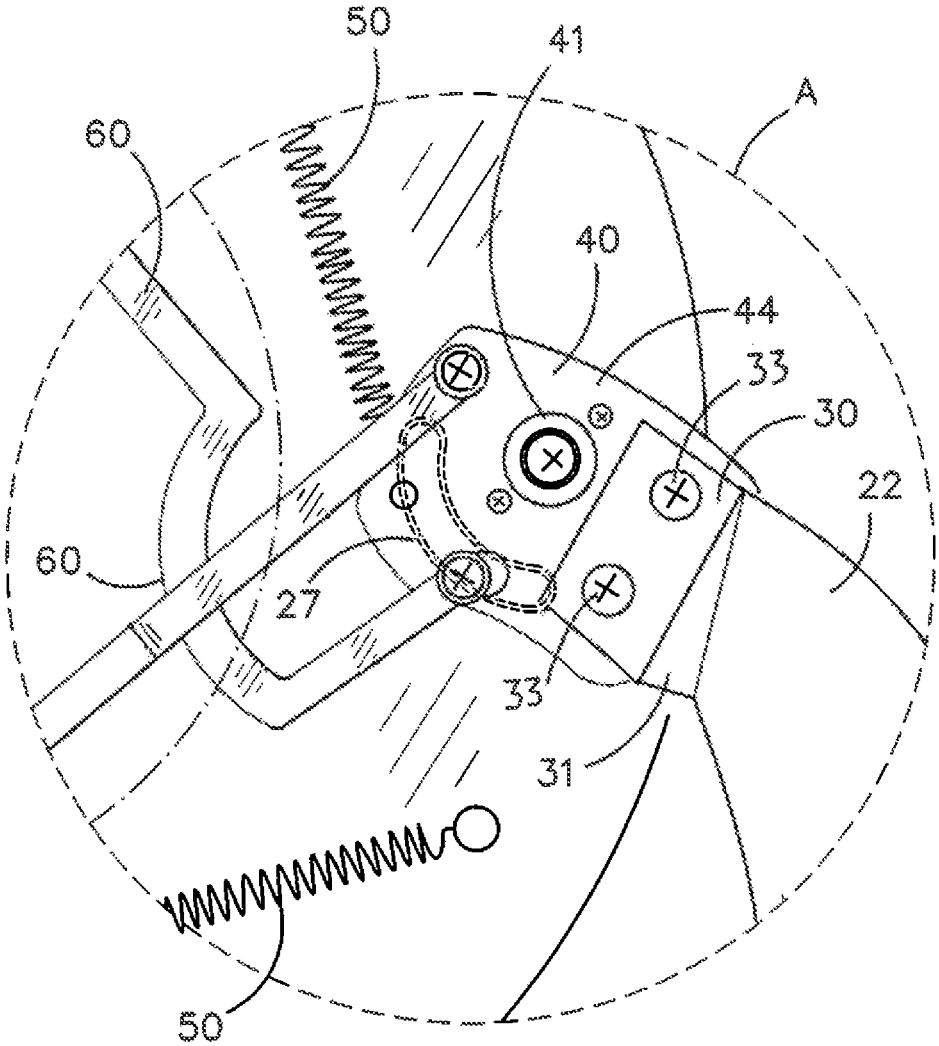
FIG. 5 is a detailed view within the circle A of FIG. 4.

As shown in FIGS. 2 to 9 of the accompanying drawings each blade 21 to 24 has a curved profile terminating at one end in a root 30 and at the other end in a curved tip 32. The root 30 of each blade is secured by fasteners 33 to a quadrant 40 that is in turn pivotally secured to the plate 20 at a position spaced inwardly of the outer periphery of the plate 20. As shown in FIG. 4 each quadrant 40 is equally spaced around the periphery of the plate 20.

Figure 9:
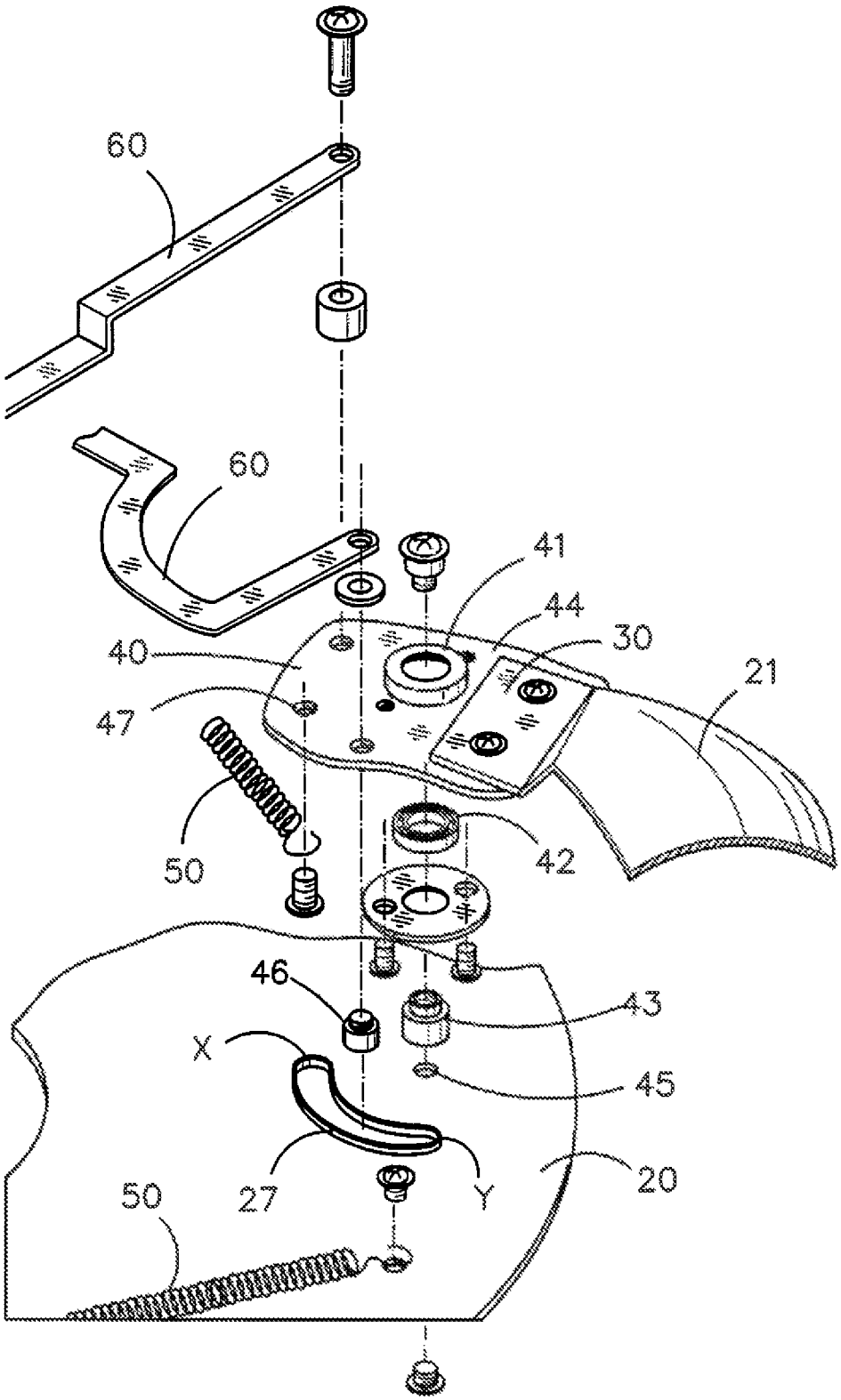
FIG. 9 is a perspective exploded view illustrating the connection of one blade to the plate.

The mounting of each quadrant 40 to the plate 20 is shown in particular detail in FIG. 9 which is an exploded view of the assembly. The quadrant 40 is a metal flange 44 of substantially rectangular configuration having a central boss 41. The root 30 of the fan blade 21 is screwed to one end of the flange 44 as shown in FIG. 9. The central boss 41 accommodates a bearing assembly 42 and spacer 43 that is located within a hole 45 in the plate 20 to elevate the quadrant 40 above the plate 20 whilst allowing the quadrant 40 to rotate about the bearing 42 about a vertical axis. The plate 20 has an arcuate slot 27 formed therein and the quadrant 40 has a downwardly projecting lug 46 that is screwed to the underside of the flange 44 to locate within the arcuate slot 27. The location of the lug 46 in the slot 27 restricts the pivoting movement of the quadrant 40 from a first position X in which the blade 21 is in a retracted configuration to a second position Y in which the blade has expanded radially outwardly and is an open operative position.

An elongate coil spring 50 is attached to a hole 47 in one corner of the flange 44 and extends across the plate 20 to be attached to a location point 51 a location point spaced away from the quadrant 40. The coil spring 50 urges the quadrant 40 to assume the closed position and when the blade 21 pivots radially outwardly the quadrant 40 moves to place the spring 50 under tension. As shown in FIG. 4 each quadrant 40 is coupled to the plate 20 in the same manner and each quadrant includes a coil spring 50 secured to the plate 20 at a position remote from the quadrant.

As shown in FIG. 9 the root 30 of each blade 21 to 24 is slightly upwardly stepped 31 and the blades are configured so that when retracted as shown in FIG. 2 the blades do not contact each other. Similarly as the blades pivot outwardly to the operative position it is understood that the surface of the blades do not contact each other.

Figure 6:
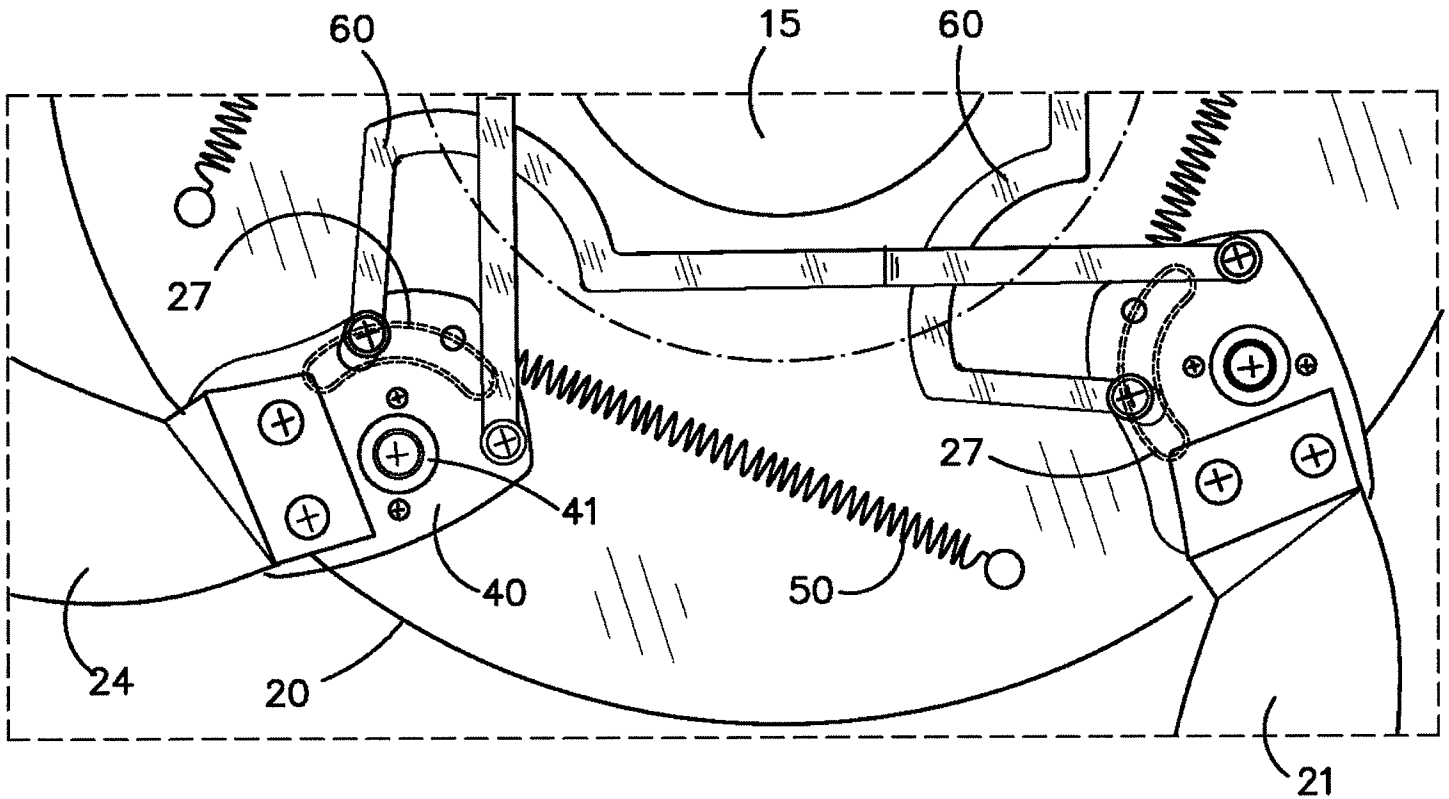
FIG. 6 is a plan view showing interconnection of adjacent blades.

FIGS. 3 and 4 illustrate that each quadrant is connected to the adjacent quadrant through a tie bar 60 as shown in FIG. 6 each tie bar 60 comprises a straight section 61 that joins a curved section 62 that in turn has a perpendicular leg 63 that is secured to the adjacent quadrant 40. The curved section 62 and leg 63 of each tie bar 60 allows the quadrants 40 to rotate through the confined arcuate movement without impeding the tie bars 60. The tie bars of a rigid construction and are screwed at either end to adjacent quadrants 40.

Figure 7:
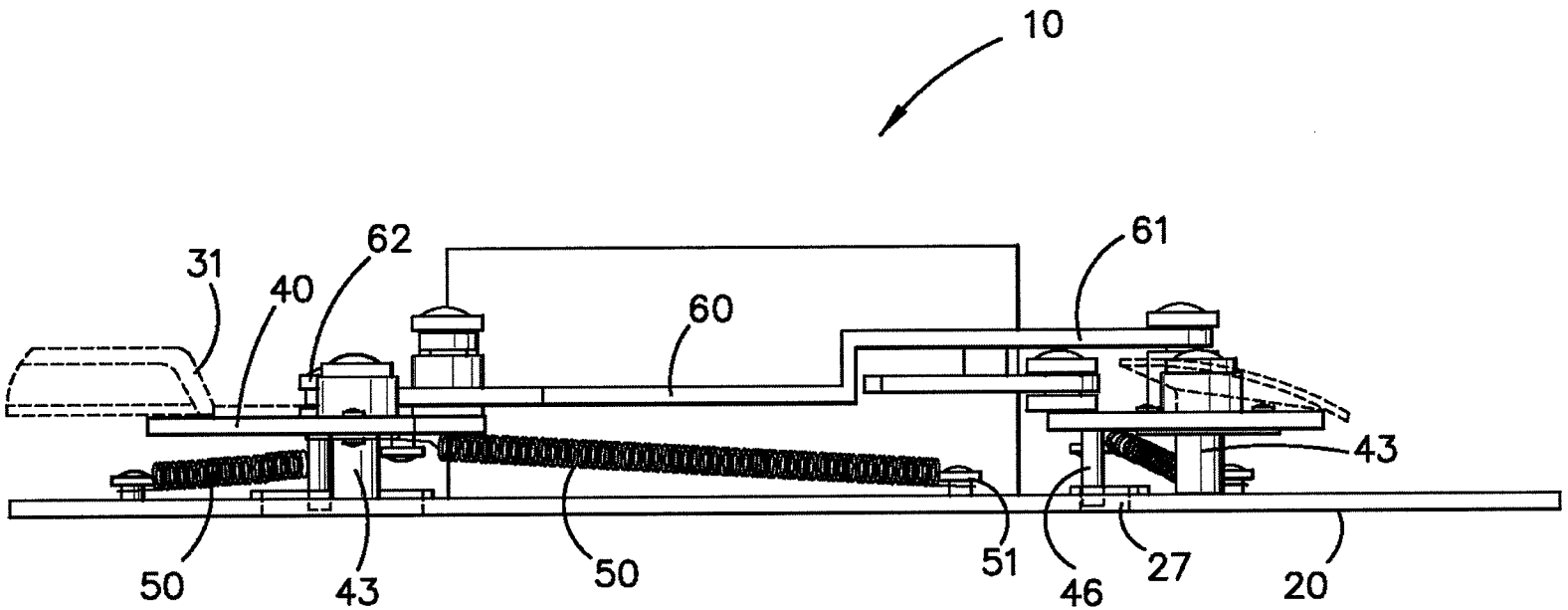
FIG. 7 is a side elevational view of the two blades shown in FIG. 6.
Figure 8:
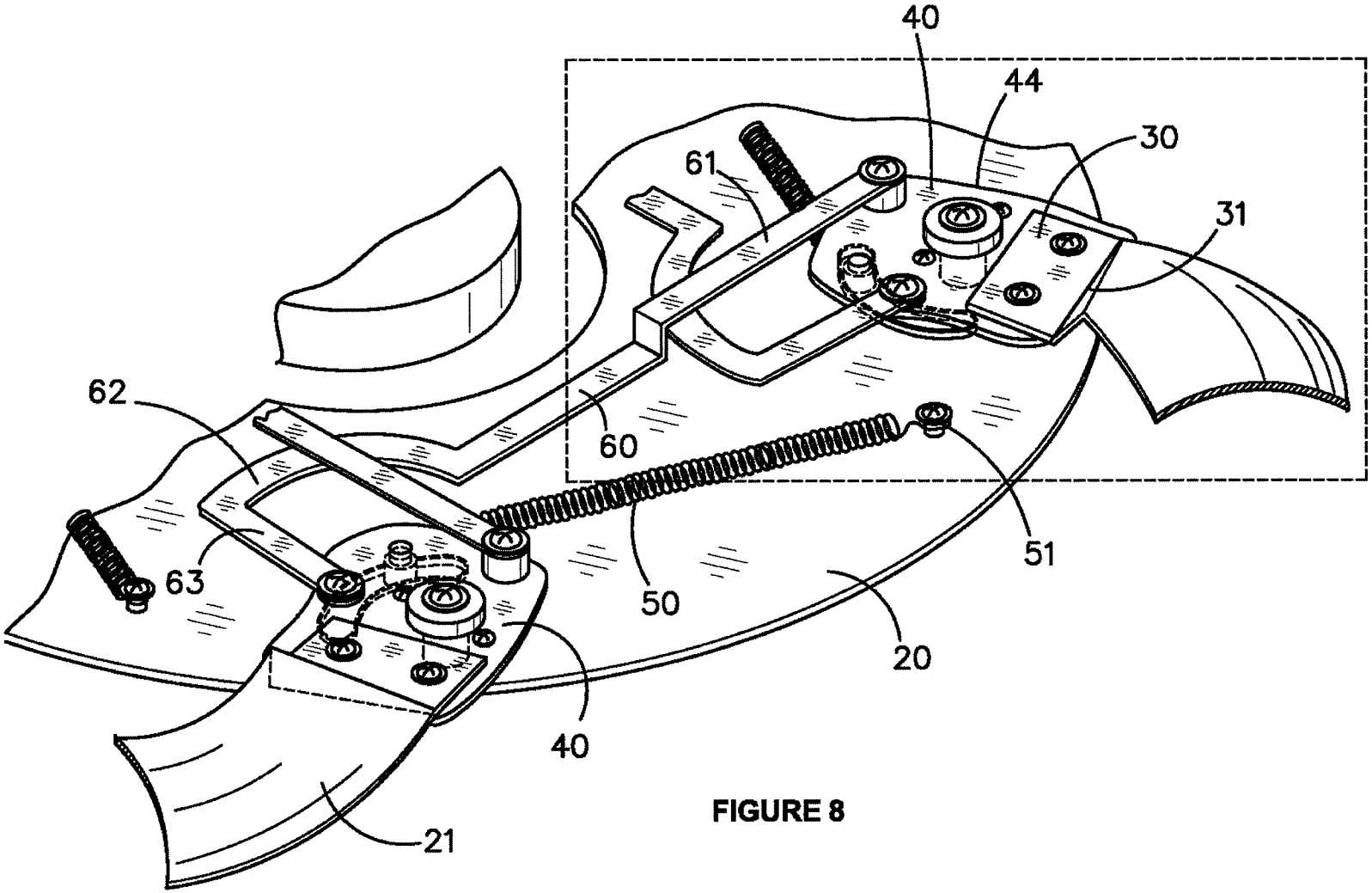
FIG. 8 is a perspective view of the two blades.

As shown in FIG. 7 the mounting point for the legged end 63 of a quadrant is lower than the elongate end 61. This height difference ensures that the tie bars 60 do not impede each other during movement of the quadrants 40. Thus the tie bars 60 join each quadrant 40 so that any movement of one quadrant 40 has to be controlled by the tie bars 60 to equate to the movement of all the other quadrants. In this way the radial outward movement of the fan blades is synchronised and each blade can only move in or out in synchronisation with the three other blades.

Thus, in use, the four coil springs 50 cause the fan blades to assume the configurations shown in FIGS. 2 and 3, that is the folded configuration. As the fan commences to rotate the centrifugal forces cause the blades to move radially outwardly causing the quadrants to pivot and the legs 46 to move within the arcuate slots 27 against the coil springs 50 until the blades assume a fully expanded configuration where the lug 46 in each arcuate slot 27 is located at the end Y of that slot. This is the fully operational position of the blades allowing the fan to operate as a conventional ceiling sweep fan. When the motor is switched off the coil springs 50 pull the blades back to the folded configuration shown in FIGS. 2 and 3.

Although, not essential, the underside of the plate carries a light fitting so that when the blades are in the retracted position the fan assumes the role of a ceiling mounted light.

The shape of the blades and the mounting configuration is arranged to ensure that the assembly is balanced and that there is no contact between the blades as they expand or retract. The tie bars 60 also operate to ensure synchronisation of movement which is essential to keep the assembly balanced.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. A ceiling fan comprising an electric motor that drives a plate, the plate supporting three or four equally spaced members positioned adjacent its periphery, each member connecting a blade with the plate and being secured to the plate to be pivotal thereto to provide limited arcuate movement, each member having a fan blade secured thereto, the arcuate movement of each member being confined from a retracted position where the blades are substantially within the periphery of the plate to an open position where the blades extend radially outwardly of the plate, each member being urged by resilient means into the refracted position, each member being directly joined to the adjacent member by a tie bar so that any movement of one member causes the same movement of the other members, and wherein adjacent tie bars overlap one another without contact as the blades move from the retracted to the open positions.

2. The ceiling fan according to either claim 1 wherein the plate has an arcuate slot for each member in which is located a lug that projects downwardly from the respective member.

3. The ceiling fan according to claim 1 wherein the plate is positioned over a stationary housing that contains a light.

4. The ceiling fan according to claim 1 wherein the resilient means is a coil spring having one end attached to the plate and the other attached to the member.

5. The ceiling fan according to claim 1 wherein each tie bar has ends pivotally secured to adjacent members.

6. The ceiling fan according to claim 1 wherein each blade has a curved profile in plan view with a root at one end and a curved tip at the other end.

7. The ceiling fan according to claim 6 wherein the root is stepped so that the blades do not contact each other when in the refracted position.

8. The ceiling fan according to claim 1 wherein the blades are molded in plastics.

* * * * *